US008757780B2

(12) United States Patent
Xie et al.

(10) Patent No.: US 8,757,780 B2
(45) **Date of Patent: *Jun. 24, 2014**

(54) CORRUGATED MEMBRANE MEMS ACTUATOR

(75) Inventors: Yonglin Xie, Pittsford, NY (US); Qing Yang, Pittsford, NY (US); James A. Katerberg, Kettering, OH (US)

(73) Assignee: Eastman Kodak Company, Rochester, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/552,728

(22) Filed: Jul. 19, 2012

(65) Prior Publication Data

US 2014/0022310 A1 Jan. 23, 2014

(51) Int. Cl.
*B41J 2/05* (2006.01)

(52) U.S. Cl.
USPC ..... 347/65; 347/67

(58) Field of Classification Search
None
See application file for complete search history.

(56) References Cited

U.S. PATENT DOCUMENTS

| | | | | |
|---|---|---|---|---|
| 1,329,559 | A | 2/1920 | Tesla | |
| 3,614,677 | A | 10/1971 | Wilfinger | |
| 4,480,259 | A | 10/1984 | Kruger et al. | |
| 5,767,612 | A * | 6/1998 | Takeuchi et al. | 310/324 |
| 6,130,690 | A | 10/2000 | Ahn | |
| 6,284,436 | B1 * | 9/2001 | Ahn et al. | 430/320 |
| 6,312,109 | B1 | 11/2001 | Chen | |
| 6,336,711 | B1 | 1/2002 | Ahn | |
| 6,345,883 | B1 | 2/2002 | Shin et al. | |
| 6,378,991 | B1 | 4/2002 | Lim et al. | |
| 6,431,688 | B1 | 8/2002 | Shin et al. | |
| 6,705,716 | B2 * | 3/2004 | Mott | 347/94 |
| 2010/0321444 | A1 * | 12/2010 | Xie | 347/54 |

FOREIGN PATENT DOCUMENTS

| | | |
|---|---|---|
| EP | 0 845 358 | 6/1998 |
| EP | 0 882 592 | 9/2005 |

OTHER PUBLICATIONS

Deng et al., "Optimization of No-Moving Part fluidic Resistance Microvalves With Low Reynolds Number", 978-1-4244-5764-9/10 2010 IEEE, pp. 67-70.

Scheeper et al., "The Design, Fabrication, and Testing of Corrugated Silicon Nitride Diaphragms", *Journal of Microelectromechanical Systems*, vol. 3, No. 1, Mar. 1994, pp. 36-42.

* cited by examiner

*Primary Examiner* — Geoffrey Mruk
(74) *Attorney, Agent, or Firm* — William R. Zimmerli

(57) ABSTRACT

A liquid dispenser includes a first liquid chamber and a second liquid chamber. The first liquid chamber includes a nozzle. A heater is associated with the second liquid chamber. A flexible corrugated membrane is positioned to separate and fluidically seal the first liquid chamber and the second liquid chamber from each other.

11 Claims, 11 Drawing Sheets

CORRUGATED MEMBRANE MEMS ACTUATOR

CROSS REFERENCE TO RELATED APPLICATIONS

Reference is made to commonly-assigned, U.S. patent application Ser. No. 13/552,721, entitled "CORRUGATED MEMBRANE MEMS ACTUATOR FABRICATION METHOD", Ser. No. 13/552,735, entitled "MEMBRANE MEMS ACTUATOR WITH MOVING WORKING FLUID", all filed concurrently herewith.

FIELD OF THE INVENTION

This invention relates generally to the field of digitally controlled liquid dispensing devices and, in particular, to liquid dispensing devices that include a flexible membrane.

BACKGROUND OF THE INVENTION

Ink jet printing has become recognized as a prominent contender in the digitally controlled, electronic printing arena because of its non-impact, low-noise characteristics, its use of plain paper, and its avoidance of toner transfer and fixing. Ink jet printing mechanisms can be categorized by technology as either drop on demand ink jet (DOD) or continuous ink jet (CIJ).

Continuous inkjet printing uses a pressurized liquid source that produces a stream of drops some of which are selected to contact a print media (often referred to a "print drops") while other are selected to be collected and either recycled or discarded (often referred to as "non-print drops"). For example, when no print is desired, the drops are deflected into a capturing mechanism (commonly referred to as a catcher, interceptor, or gutter) and either recycled or discarded. When printing is desired, the drops are not deflected and allowed to strike a print media. Alternatively, deflected drops can be allowed to strike the print media, while non-deflected drops are collected in the capturing mechanism.

Drop on demand printing only provides drops (often referred to a "print drops") for impact upon a print media. Selective activation of an actuator causes the formation and ejection of a drop that strikes the print media. The formation of printed images is achieved by controlling the individual formation of drops. Typically, one of two types of actuators is used in drop on demand printing devices—heat actuators and piezoelectric actuators. When a piezoelectric actuator is used, an electric field is applied to a piezoelectric material possessing properties causing a wall of a liquid chamber adjacent to a nozzle to be displaced, thereby producing a pumping action that causes an ink droplet to be expelled. When a heat actuator is used, a heater, placed at a convenient location adjacent to the nozzle, heats the ink. Typically, this causes a quantity of ink to phase change into a gaseous steam bubble that displaces the ink in the ink chamber sufficiently for an ink droplet to be expelled through a nozzle of the ink chamber.

In some applications it may be desirable to use an ink that is not aqueous and, as such, does not easily form a vapor bubble under the action of the heater. Heating some inks may cause deterioration of the ink properties, which can cause reliability and quality issues. As described in U.S. Pat. No. 4,480,259 and U.S. Pat. No. 6,705,716, one solution is to have two fluids in the print head with one fluid dedicated to respond to an actuator, for example, to create a vapor bubble upon heating, while the other fluid is the ink. The performance capabilities of these types of print heads is often limited due to the resistance of the membrane or diaphragm that separates the actuator fluid from the ink which reduces the amount of volumetric displacement that occurs in ink chamber as a result of the pressure caused by the vaporization of the actuator fluid.

Although U.S. Pat. No. 4,480,259 and U.S. Pat. No. 6,705,716 both describe flexible diaphragms, it is well understood by one skilled in the art that it is difficult to manufacture a micro-fluidics device such as an ink jet print head using conventional MEMS technology while incorporating a sufficiently elastic material for use as a diaphragm. Additionally, repeated cycles of stretch and relax cause material fatigue in the diaphragm resulting in reduced device reliability and poor device performance.

As such, there is an ongoing effort to increase the reliability and performance of print heads that include two fluids and a flexible membrane.

SUMMARY OF THE INVENTION

According to one aspect of the present invention, a liquid dispenser includes a first liquid chamber and a second liquid chamber. The first liquid chamber includes a nozzle. A heater is associated with the second liquid chamber. A flexible corrugated membrane is positioned to separate and fluidically seal the first liquid chamber and the second liquid chamber from each other.

According to another aspect of the present invention, a method of printing includes providing a liquid dispenser made in accordance with the invention described herein and using it to dispense liquid drops.

According to another aspect of the present invention, a liquid dispenser includes an ink chamber that contains a liquid that is located next to and shares a common side wall with a working fluid chamber. The ink chamber includes a nozzle outlet through which ink is ejected when an actuator located in the working fluid chamber is actuated. The nozzle outlet is opposite the shared side wall. The shared side wall between the working fluid chamber and the ink chamber includes a corrugated flexible diaphragm that is displaced by operation of the actuator. For example, the corrugated flexible diaphragm can be displaced by a vapor bubble created in the working fluid chamber by actuating a heater actuator. The displacement of the flexible membrane then displaces the ink in the ink chamber resulting in an ejection of ink though the ink nozzle.

BRIEF DESCRIPTION OF THE DRAWINGS

In the detailed description of the example embodiments of the invention presented below, reference is made to the accompanying drawings, in which.

DETAILED DESCRIPTION OF THE INVENTION

Figure 1:
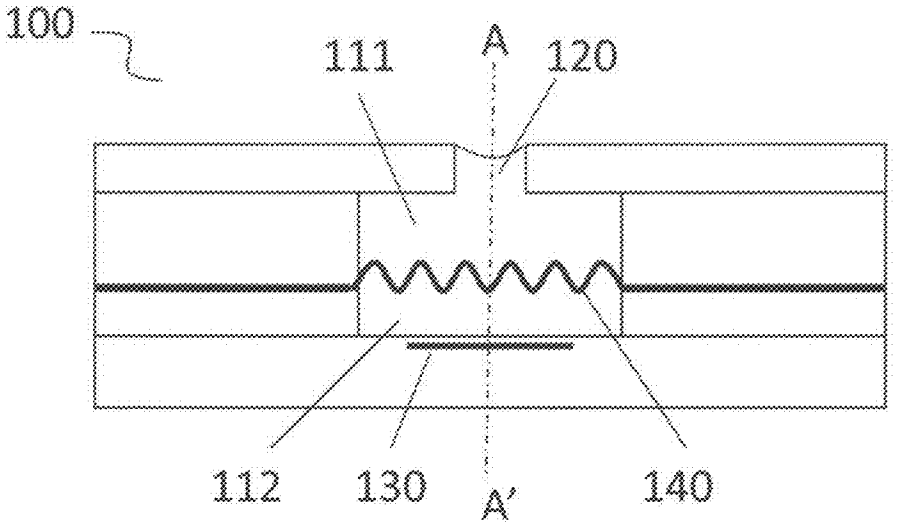
FIG. 1 is a schematic cross sectional view of an example embodiment of a liquid dispenser made in accordance with the present invention.

The present description will be directed in particular to elements forming part of, or cooperating more directly with, apparatus in accordance with the present invention. It is to be understood that elements not specifically shown or described may take various forms well known to those skilled in the art. In the following description and drawings, identical reference numerals have been used, where possible, to designate identical elements.

The example embodiments of the present invention are illustrated schematically and not to scale for the sake of clarity. One of the ordinary skills in the art will be able to readily determine the specific size and interconnections of the elements of the example embodiments of the present invention.

As described herein, the example embodiments of the present invention provide a liquid dispenser, often referred to as a print head, which is particularly useful in digitally controlled inkjet printing devices in which drops of ink are ejected from a print head toward a print medium. However, many other applications are emerging which use liquid dispensers, similar to inkjet print heads, to emit liquids, other than inks, that need to be finely metered and deposited with high spatial precision. As such, as described herein, the terms "liquid" and "ink" are used interchangeably and refer to any material, not just inkjet inks, which can be ejected by the example embodiments of the liquid dispenser described below.

In addition to inkjet printing applications in which the fluid typically includes a colorant for printing an image, the liquid dispenser of the present invention is also advantageously used in ejecting other types of fluidic materials. Such materials include functional materials for fabricating devices (including conductors, resistors, insulators, magnetic materials, and the like), structural materials for forming three-dimensional structures, biological materials, and various chemicals. The liquid dispenser of the present invention provides sufficient force to eject fluids having a higher viscosity than typical inkjet inks, and does not impart excessive heat into the fluids that could damage the fluids or change their properties undesirably.

Referring to FIG. 1, a liquid dispenser 100 including a membrane MEMS actuator is shown. Liquid dispenser 100 includes a first liquid chamber 111 and a second liquid chamber 112. A flexible membrane 140 is positioned in liquid dispenser 100 to separate and fluidically seal the first liquid chamber 111 and the second liquid chamber 112. As shown in FIG. 1, flexible membrane 140 is corrugated when flexible membrane 140 is in an unactuated position or state (often referred to as an at rest position or state). The overall shape of flexible membrane 140 is planar when viewed, as shown in FIG. 1, from end to end of flexible membrane 140. First liquid chamber 111 includes a nozzle 120.

Liquid dispenser 100 includes a selectively actuatable thermal actuator that uses heat energy to divert a portion of a liquid (often referred to as a first liquid) located in first liquid chamber 111 through nozzle 120. The thermal actuator includes a heater in one example embodiment of the invention that is commonly referred to as a "bubble jet" heater. When selectively actuated, the heat generated by this type of thermal actuator vaporizes a portion of a liquid (often referred to as a second liquid) in the vicinity of the actuator creating a vapor bubble 160 (shown in FIG. 2) which causes the first liquid to the ejected through nozzle 120.

Referring back to FIG. 1, a heater 130 is associated with second liquid chamber 112. Heater 130 is located in a wall of the second liquid chamber 112 opposite flexible corrugated membrane 140. As shown in FIG. 1, heater 130 is a "bubble jet" type heater. A center axis A-A' extends through the center of nozzle 120. Nozzle 120 includes a center point, heater 130 includes a center point, and flexible corrugated membrane 140 includes a center point. As shown in FIG. 1, the center points of nozzle 120, heater 130, and flexible corrugated membrane 140 are collinear relative to each other and located on center axis A-A'. The overall shape of flexible membrane 140 is symmetric relative to center axis A-A' when viewed, as shown in FIG. 1, from end to end of flexible membrane 140.

First chamber 111 is adapted to receive a liquid that is supplied to first chamber 111 in a conventional manner. Second chamber 112 is adapted to receive a liquid that is supplied to second chamber 112 in a conventional manner or in a manner according to one aspect of the present invention (described in more detail below). As flexible membrane 140 fluidically seals first chamber 111 and second chamber 112 from each other, first chamber 111 and second chamber 112 are physically distinct from each other which allows the first liquid and the second liquid present in each respective chamber to be different types of liquid when compared to each other in example embodiments of the invention.

Figure 2:
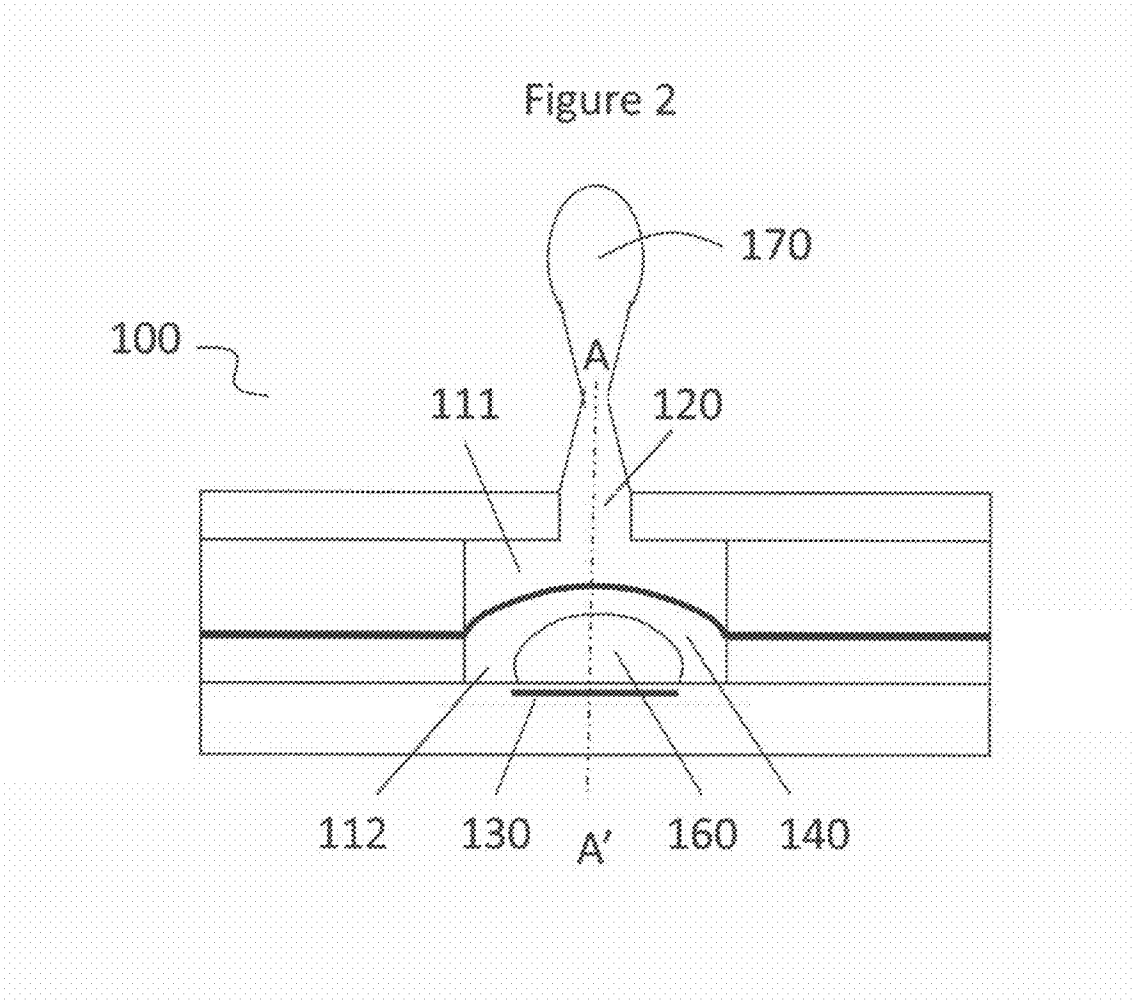
FIG. 2 is a schematic cross sectional view of the example embodiment shown in FIG. 1 in an actuated state.

Referring to FIG. 2, a portion of a liquid (often referred to as a second liquid) located in second liquid chamber 112 is vaporized, forming a vapor bubble 160, when electric energy is applied to heater 130. The pressure resulting from the expanding vapor bubble 160 pushes flexible corrugated membrane 140 toward nozzle 120 (up as shown in FIG. 2) and causes flexible corrugated membrane 140 to bend and straighten. This can also be referred to as an actuated position or state of flexible membrane 140. The displacement of the flexible corrugated membrane 140 pressurizes a liquid (often referred to as a first liquid) located in first liquid chamber 111 causing a liquid drop 170 to be ejected through nozzle 120.

Figure 3:
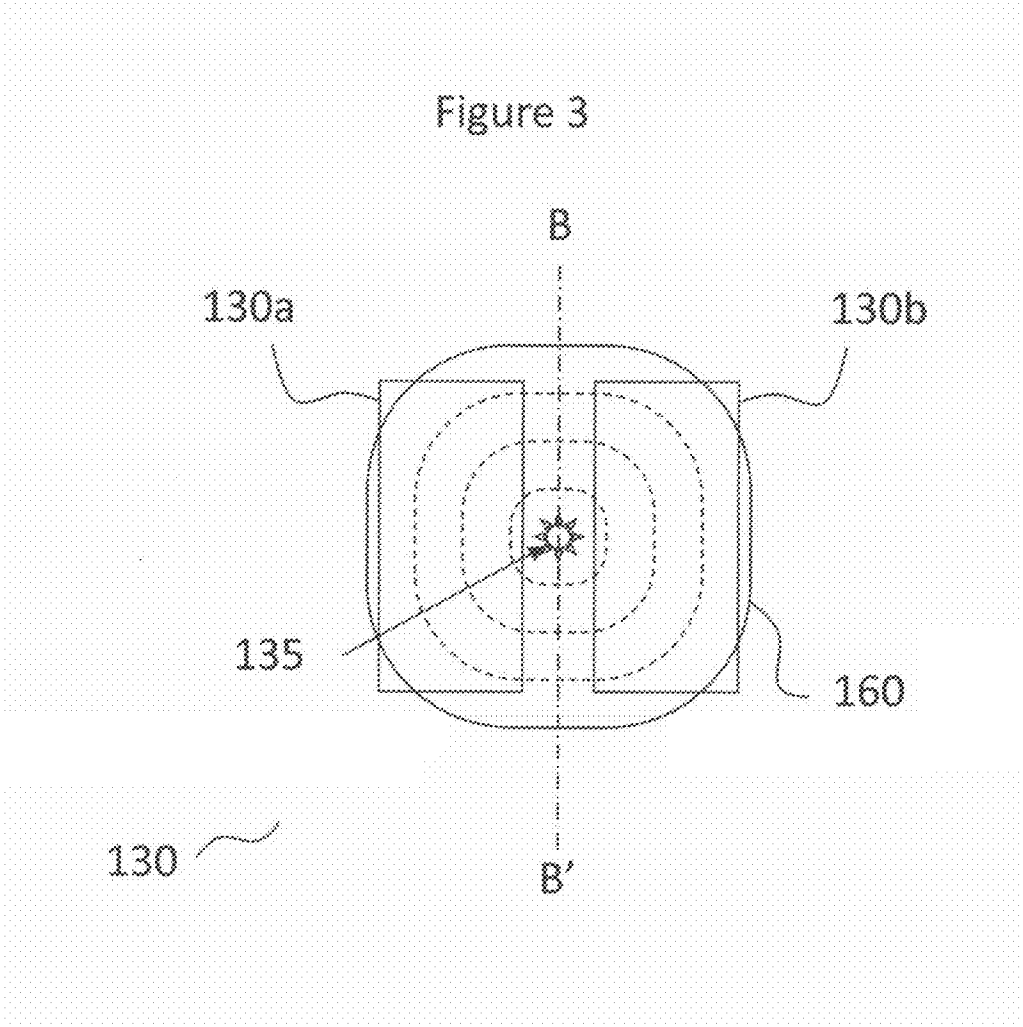
FIG. 3 is a schematic top view of an example embodiment of a heater included in an example embodiment of a liquid dispenser made in accordance with the present invention.

Referring to FIG. 3, heater 130 includes a split heater structure as viewed along the direction of center axis A-A'. The split heater 130 includes two halves 130*a* and 130*b* symmetrically positioned relative to a plane B-B' that includes the center point 135 of the heater 130. Vapor bubble 160 is shown in FIG. 3 as concentric rings. The split heater configuration allows vapor bubble 160 to collapse at the center point 135 of the heater 130, reducing or even avoiding cavitation damage to the heater. Other heater 130 structures or configurations can be included in alternative example embodiments of the invention.

Figure 4:
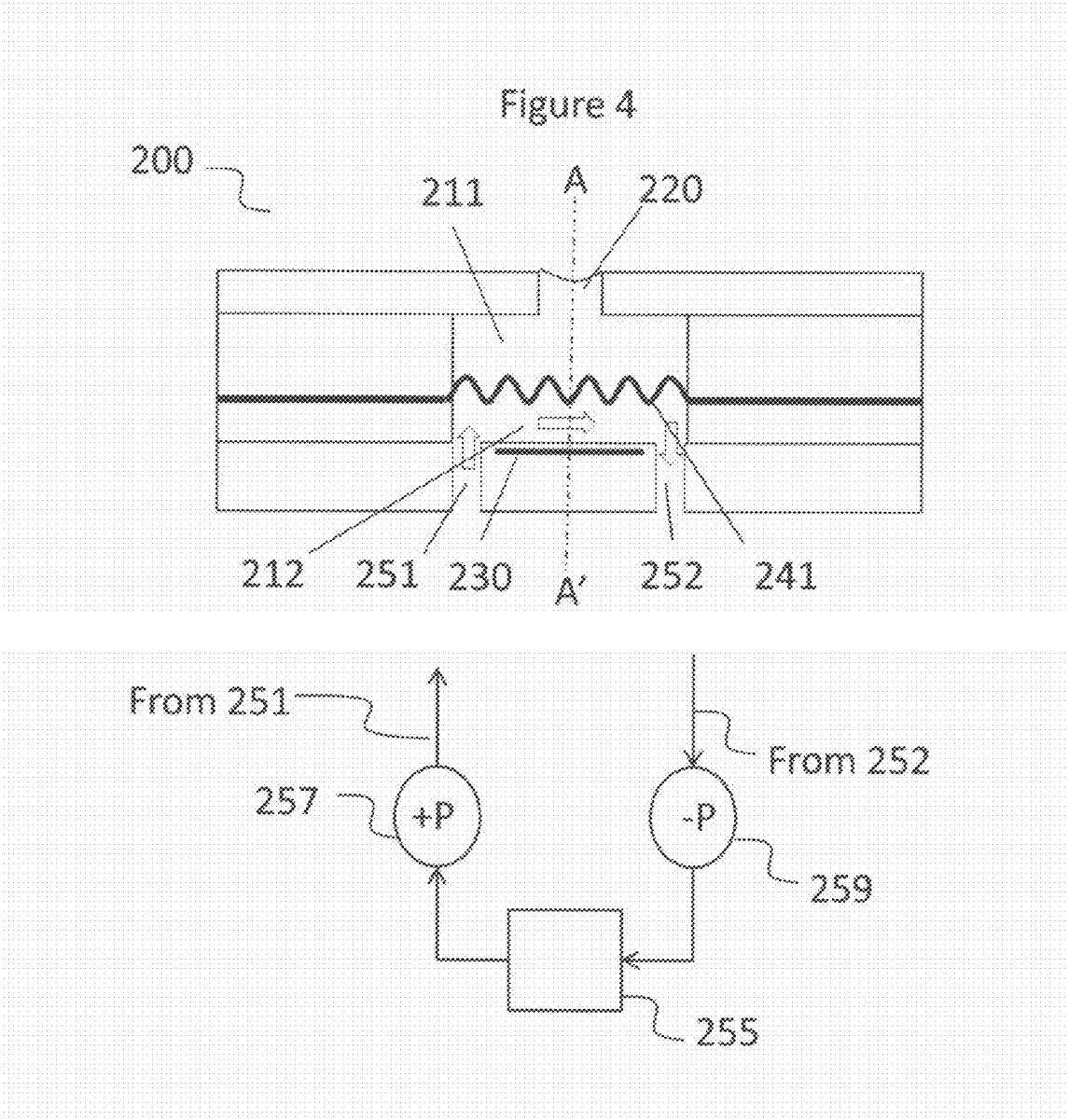
FIG. 4 is a schematic cross sectional view of another example embodiment of a liquid dispenser made in accordance with the present invention.

Referring to FIG. 4, a liquid dispenser 200 including a circulating working fluid is shown. Liquid dispenser 200 includes a first liquid chamber 211 that is in fluid communication with a nozzle 220. A heater 230 is associated with a second liquid chamber 212. A flexible membrane 241 is positioned to separate and fluidically seal the first liquid chamber 211 and the second liquid chamber 212 from each other. A thermal actuator, for example, a heater 230, is located in a wall of second liquid chamber 212 opposite flexible membrane 241.

As described above and shown in FIG. 4, flexible membrane 241 is corrugated when in an unactuated or at rest position. The overall shape of flexible membrane 241 is planar when viewed from end to end of flexible membrane 241. The overall shape of flexible membrane 241 is symmetric relative to center axis A-A' when viewed, as shown in FIG. 1, from end to end of flexible membrane 241. A center point of nozzle 220, heater 230, and flexible membrane 241 are collinear relative to each other and located along center axis A-A' that extends through the center of nozzle 220.

A liquid supply channel 251 is in fluid communication with second chamber 212 and a liquid return channel 252 is in fluid communication with second chamber 212. Liquid supply channel 251 and liquid return channel 252 are also in fluid communication with a liquid supply 255. During a drop ejection or dispensing operation, liquid supply 255 provides a liquid (commonly referred to as a working fluid or a working liquid) that flows continuously from liquid supply 255 through liquid supply channel 251 through second liquid chamber 212 through liquid return channel 252 and back to liquid supply 255. The circulating working fluid helps to increase the drop ejection frequency by removing at least some of the heat generated by heater 230 when it is actuated during drop ejection. The circulating working fluid can help increase the drop ejection frequency by pushing at least some of vapor bubble 160 off of and away from the heater 230 area as vapor bubble 160 collapses or increasing the speed of liquid replenishment relative to heater 230. As shown in FIG. 4, the liquid moves over heater 230.

Typically, liquid is supplied to first chamber 211 in a manner similar to liquid chamber refill in a conventional drop on demand device. For example, during a drop dispensing operation using liquid dispenser 200, the liquid is not continuously flowing to first chamber 211 during a drop ejection or dispensing operation. Instead, first chamber 211 is refilled with liquid on an as needed basis that is made necessary by the ejection of a drop of the liquid from first chamber 211 through nozzle 220.

Typically, a regulated pressure source 257 is positioned in fluid communication between liquid supply 255 and liquid supply channel 251. Regulated pressure source 257, for example, a pump, provides a positive pressure that is usually above atmospheric pressure. Optionally, a regulated vacuum supply 259, for example, a pump, can be included in order to better control liquid flow through second chamber 212. Typically, regulated vacuum supply 259 is positioned in fluid communication between liquid return channel 252 and liquid supply 255 and provides a vacuum (negative) pressure that is below atmospheric pressure. Liquid supply 255, regulated pressure source 257, and optional regulated vacuum supply 259 can be referred to as the liquid delivery system of liquid dispenser 200.

In one example embodiment, liquid supply 255 applies a positive pressure provided by a positive pressure source 257 at the entrance of liquid supply channel 251 and a negative pressure (or vacuum) provided by a negative pressure source 259 at the exit of liquid return channel 252. This helps to maintain the pressure inside second liquid chamber 212 at substantially the same pressure (for example, ambient pressure conditions) at the exit of nozzle 220 when the heater 230 is not energized. As a result, flexible membrane 241 is not deflected during a time period of drop dispensing when the heater 230 is not energized.

A high degree of flexibility in flexible membrane 241 is preferred to effectively transmit the pressure generated by vapor bubble 160 in the working fluid (a second liquid) to the fluid or liquid of interest (a first liquid), for example, ink, located in first chamber 211. In one example embodiment of the invention, this aspect of the invention is achieved by incorporating a corrugated shape in a high modulus material membrane. The corrugated membrane can be made out of high modulus materials such as alloys, metals, or dielectric materials, to meet fabrication requirements of mechanic strength, durability, or thinness of the flexible membrane. These types of relatively strong materials may not have a high degree of elasticity, but the effect of the corrugation helps to greatly increase the membrane flexibility without requiring the use of an elastic material when compared to non-corrugated membranes.

As flexible membrane 241 fluidically seals first chamber 211 and second chamber 212 from each other, first chamber 211 and second chamber 212 are physically distinct from each other which allows the first liquid and the second liquid present in each respective chamber to be different types of liquid when compared to each other in example embodiments of the invention. For example, the second liquid can include properties that increase its ability to remove heat while the second liquid can be an ink. The second liquid can include properties that lower its boiling point when compared to the first liquid. The second liquid can include properties that make it a non-corrosive liquid, for example, nonionic liquid, in order to improve and maintain the functionality of heater 230 or increase its lifetime.

Figure 5:
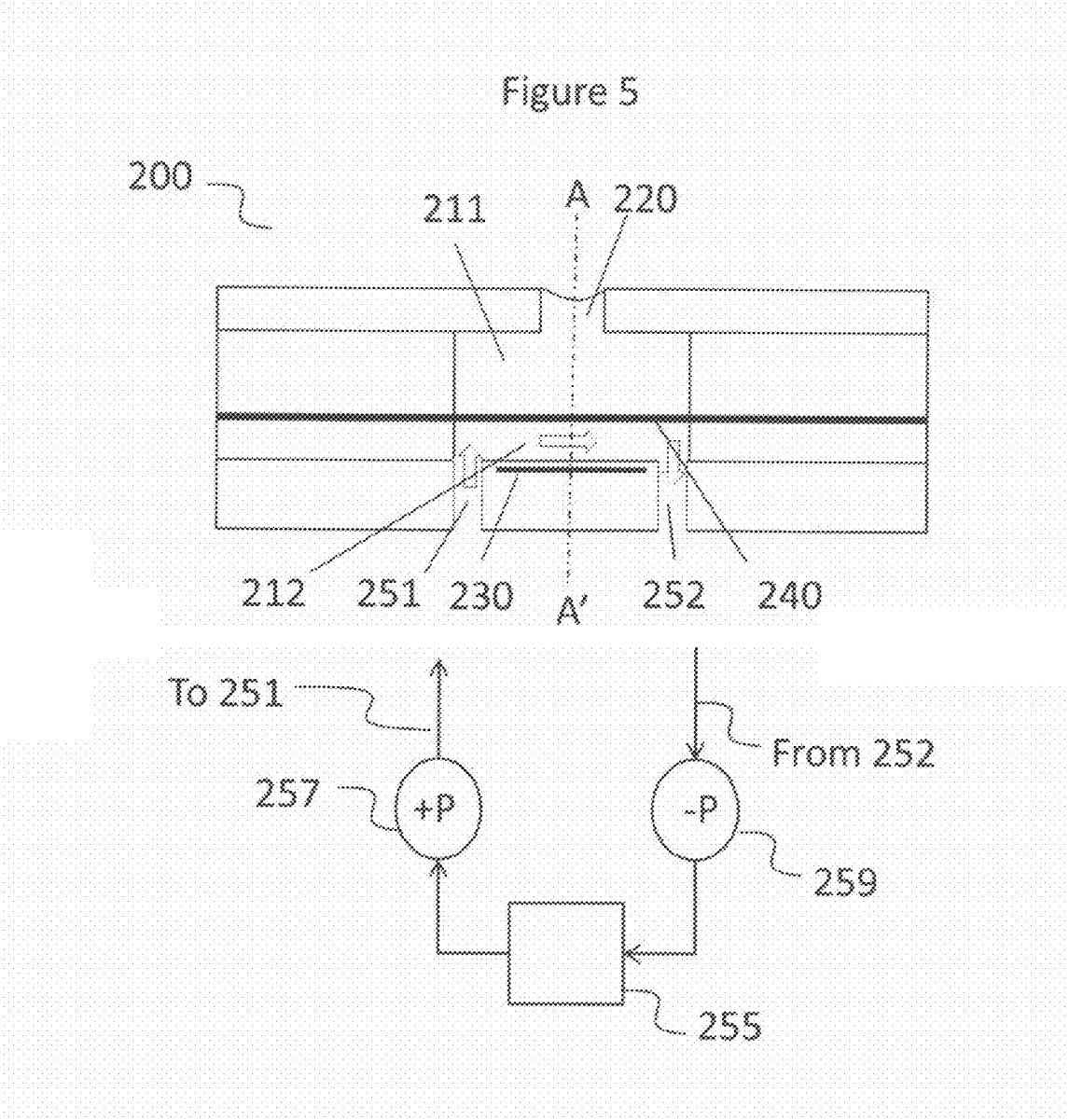
FIG. 5 is a schematic cross sectional view of another example embodiment of a liquid dispenser made in accordance with the present invention.

Referring to FIG. 5, another example embodiment of a liquid dispenser 200 including a circulating working fluid is shown. In this example embodiment, liquid dispenser includes a flexible membrane 240 that includes no corrugation when flexible membrane 240 is in an unactuated or at rest position. In this sense, flexible membrane is flat. The overall shape of flexible membrane 240 is planar when viewed from end to end of flexible membrane 240. The overall shape of flexible membrane 240 is symmetric relative to center axis A-A' when viewed, as shown in FIG. 1, from end to end of flexible membrane 240. Center points of nozzle 220, heater 230, and flexible membrane 240 are collinear relative to each other and are located along center axis A-A' that extends through the center of nozzle 220.

A liquid supply channel 251 is in fluid communication with second chamber 212 and a liquid return channel 252 is in fluid communication with second chamber 212. Liquid supply channel 251 and liquid return channel 252 are also in fluid communication with a liquid supply 255. During a drop ejection or dispensing operation, liquid supply 255 provides a liquid (commonly referred to as a working fluid or a working liquid) that flows continuously from liquid supply 255 through liquid supply channel 251 through second liquid chamber 212 through liquid return channel 252 and back to liquid supply 255. The circulating working fluid helps to increase the drop ejection frequency by removing at least some of the heat generated by heater 230 when it is actuated during drop ejection. The circulating working fluid can help increase the drop ejection frequency by pushing at least some of vapor bubble 160 off of and away from the heater 230 area as vapor bubble 160 collapses or increasing the speed of liquid replenishment relative to heater 230. As shown in FIG. 5, the liquid moves over heater 230.

Typically, a regulated pressure source 257 is positioned in fluid communication between liquid supply 255 and liquid supply channel 251. Regulated pressure source 257, for example, a pump, provides a positive pressure that is usually above atmospheric pressure. Optionally, a regulated vacuum supply 259, for example, a pump, can be included in order to better control liquid flow through second chamber 212. Typically, regulated vacuum supply 259 is positioned in fluid communication between liquid return channel 252 and liquid supply 255 and provides a vacuum (negative) pressure that is below atmospheric pressure. Liquid supply 255, regulated pressure source 257, and optional regulated vacuum supply 259 can be referred to as the liquid delivery system of liquid dispenser 200.

In one example embodiment, liquid supply 255 applies a positive pressure provided by a positive pressure source 257 at the entrance of liquid supply channel 251 and a negative pressure (or vacuum) provided by a negative pressure source 259 at the exit of liquid return channel 252. This helps to maintain the pressure inside second liquid chamber 212 at substantially the same pressure (for example, ambient pressure conditions) at the exit of nozzle 220 when the heater 230 is not energized. As a result, flexible membrane 240 is not deflected during a time period of drop dispensing when the heater 230 is not energized.

A high degree of flexibility in flexible membrane 240 is preferred to effectively transmit the pressure generated by vapor bubble 160 in the working fluid (a second liquid) to the fluid or liquid of interest (a first liquid), for example, ink, located in first chamber 211. Since flexible membrane 240 is not corrugated, an elastic material can be included with or substituted for a high modulus material during flexible membrane fabrication.

As flexible membrane 240 fluidically seals first chamber 211 and second chamber 212 from each other, first chamber 211 and second chamber 212 are physically distinct from each other which allows the first liquid and the second liquid present in each respective chamber to be different types of liquid when compared to each other in example embodiments of the invention. For example, the second liquid can include properties that increase its ability to remove heat while the second liquid can be an ink. The second liquid can include properties that lower its boiling point when compared to the first liquid. The second liquid can include properties that make it a non-corrosive liquid, for example, nonionic liquid, in order to improve and maintain the functionality of heater 230 or increase its lifetime.

Figure 6A:
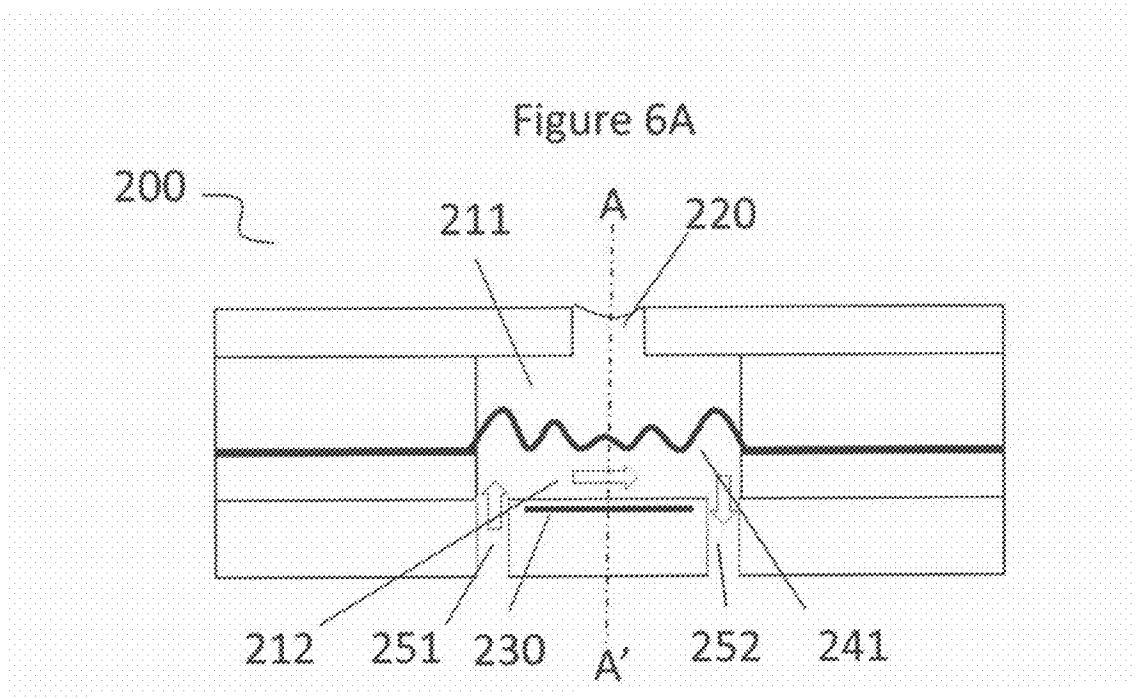
FIGS. 6A-6C are schematic top views of example embodiments of flexible membranes included in example embodiments of liquid dispensers made in accordance with the present invention.
Figure 6B:
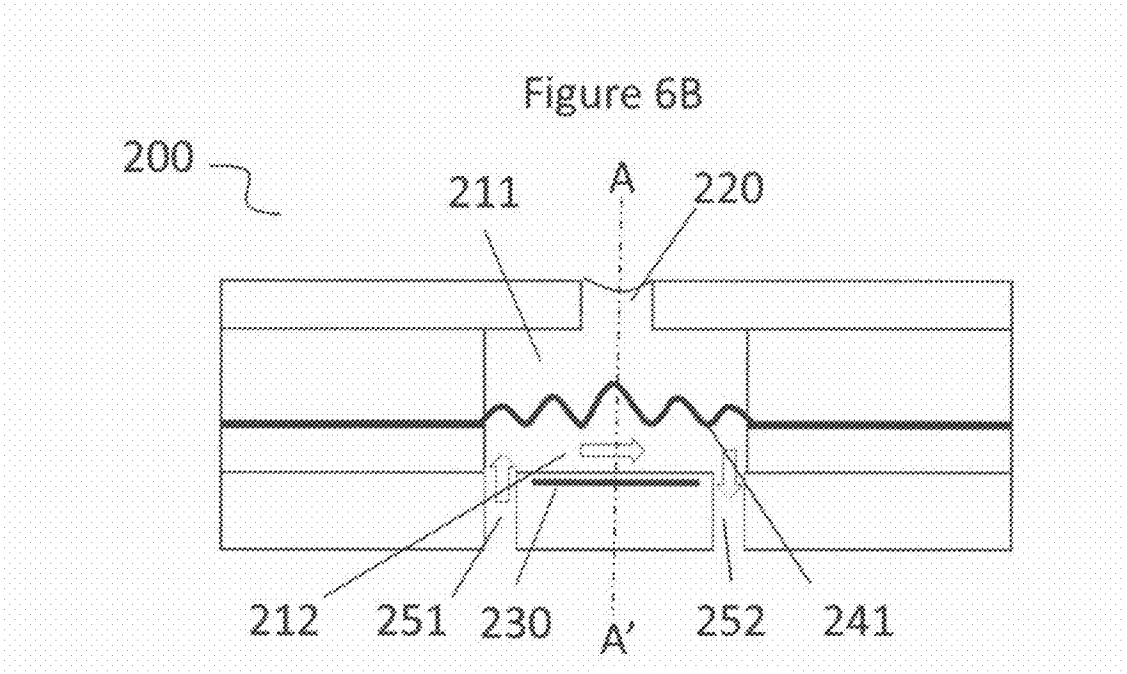
Figure 6C:
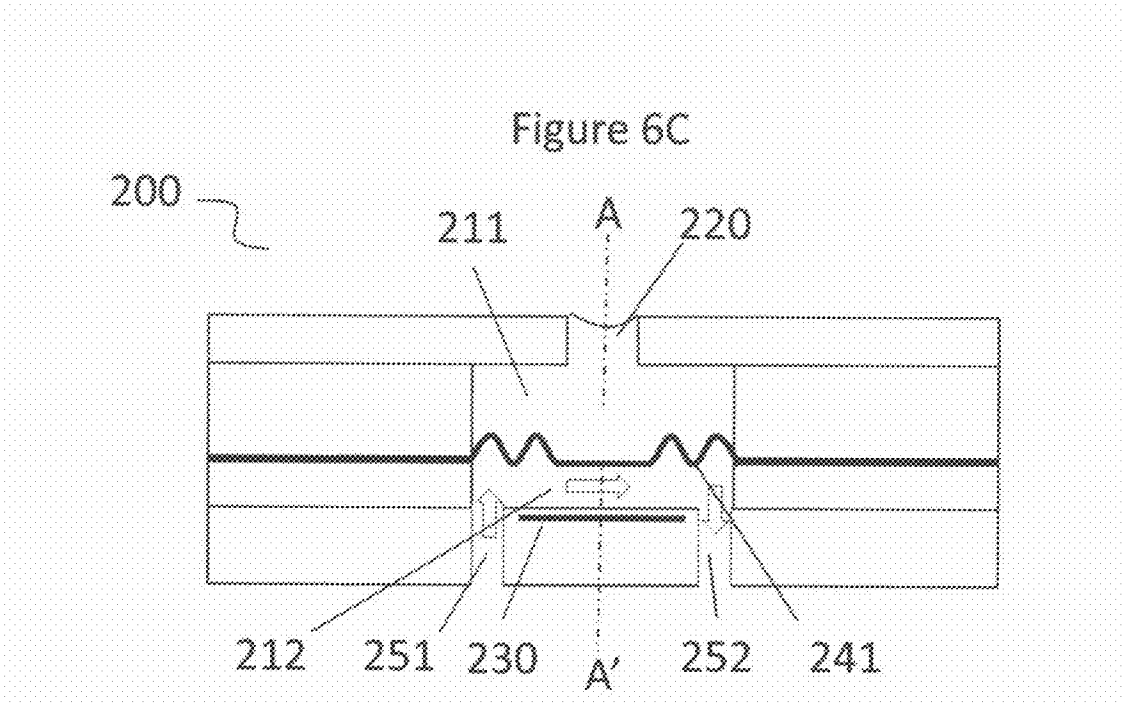

Referring to FIG. 6A-6C, example embodiments of corrugated flexible membranes 241 are shown in which the corrugations of the corrugated membrane include a variable height, a variable pitch, or a combination of both. In FIG. 6A, the height of the corrugation is larger near the edge or end region of the flexible membrane when compared to the center region of the flexible membrane. In FIG. 6B, the height of the corrugation is smaller near the edge or end region of the flexible membrane when compared to the center region of the flexible membrane. In FIG. 6C, a portion of the flexible membrane in the center region is flat and a portion of the flexible membrane near the edge or end region is corrugated. As shown in FIGS. 6A-6C, the corrugations of corrugated flexible membrane 241 are symmetric about the center point of flexible membrane 241. In FIG. 6C, the flat center region of corrugated flexible membrane 241 is symmetric about the center point of flexible membrane 241.

Figure 7A:
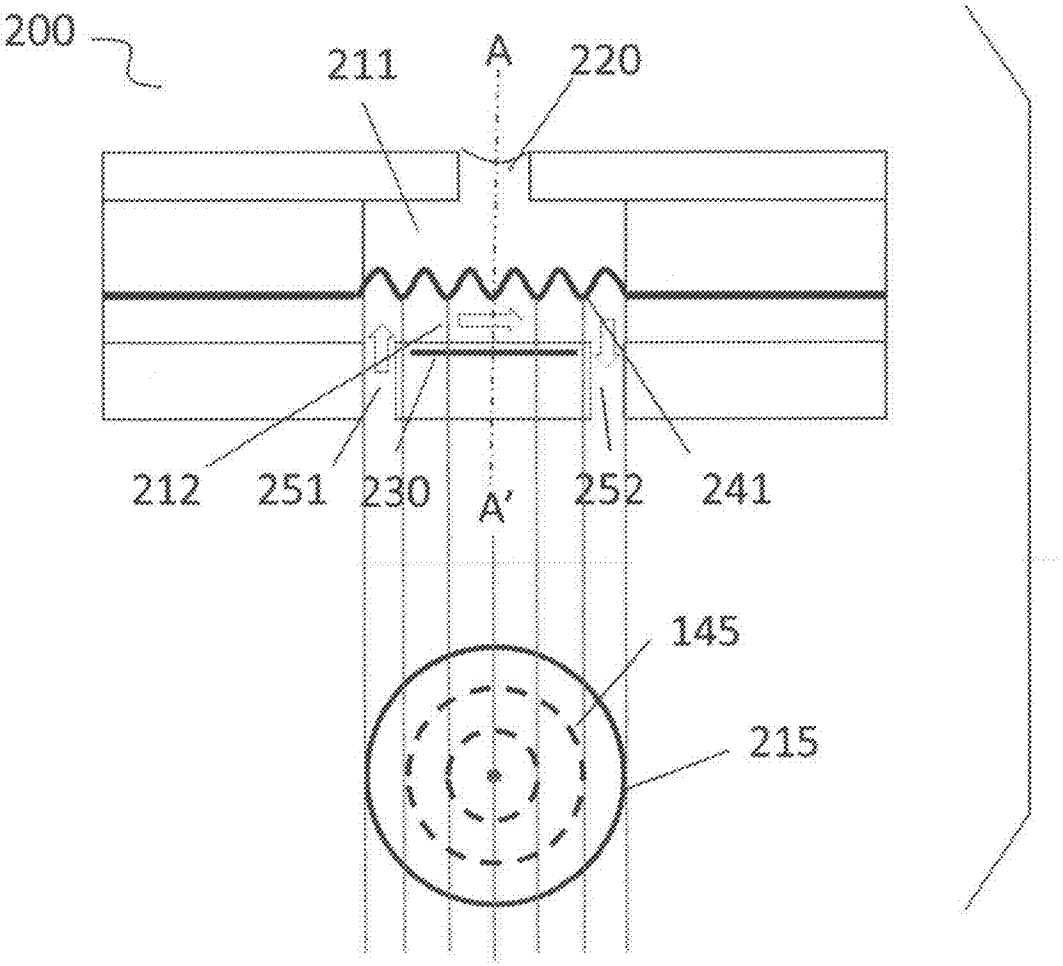
FIG. 7A-7C are schematic cross sectional and top views of example embodiments of flexible membranes included in example embodiments of liquid dispensers made in accordance with the present invention.
Figure 7B:
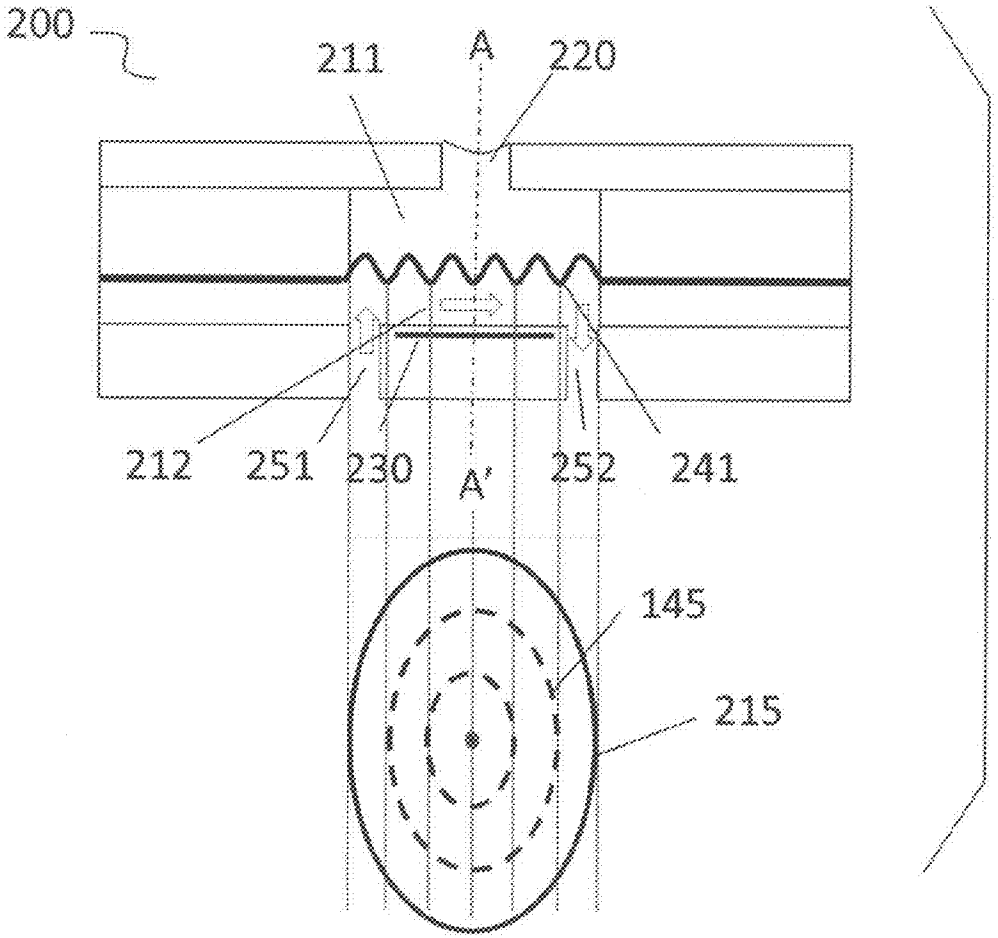
Figure 7C:
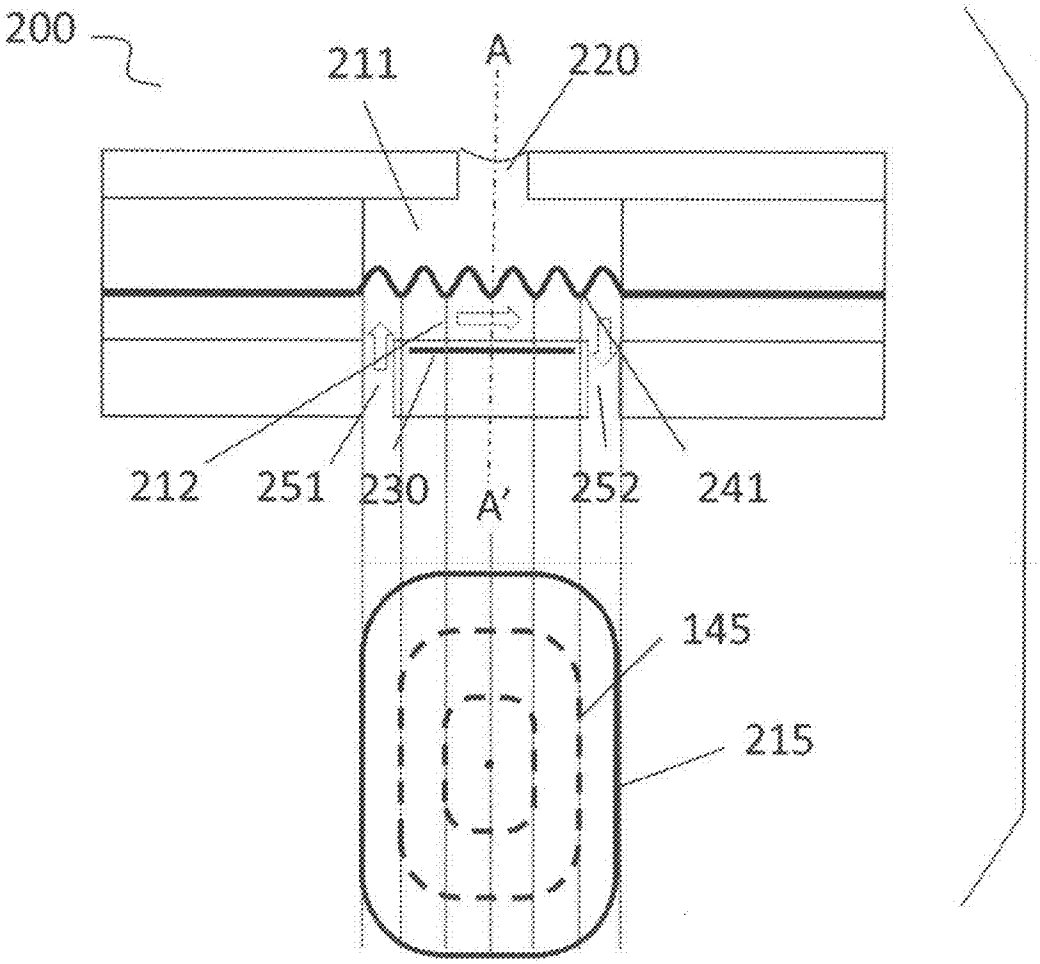

A corrugated flexible membrane including corrugations including a variable height, a variable pitch, or a combination of both is advantaged in some applications when compared to other types of membranes. One advantage includes the ability to provide a flexible membrane having a reduced overall stiffness which helps increase displacement capabilities of the flexible membrane. Another advantage includes the ability to provide a flexible membrane having a reduced variation of stress which helps increase the life of the flexible membrane. Another advantage includes the ability to direct the pressure wave in the fluid on the other side of the flexible membrane which helps increase or enhance the efficiency of the actuator. For example, this type of flexible membrane can focus the pressure wave toward or at a nozzle located on the other side of the flexible membrane in a manner that is similar to the function of a Fresnel lens. Referring to FIG. 7A-7C, various contour shapes of the corrugation(s) of corrugated flexible membrane 241 are shown. The contour shapes are viewed in a direction perpendicular to flexible membrane 241 along center axis A-A'. As shown in FIGS. 7A-7C, the contour shape of the corrugation(s) of corrugated flexible membrane 241 is similar to or the same as the shape of first fluid chamber 211 (the chamber above flexible membrane 241 as shown in FIGS. 7A-7C). In the perpendicular view of flexible membrane 241 shown in FIGS. 7A-7C, solid line 215 refers to the outer contour of first fluid chamber 211. In FIG. 7A, the outer contour is a circular shape. In FIG. 7B, the outer contour is an oval shape. In FIG. 7C, the outer contour is a complex shape and, as shown, is a rectangular shape including corners that have a radius of curvature.

In the perpendicular view of flexible membrane 241 shown in FIGS. 7A-7C, the dashed lines 145 trace the troughs of corrugations of corrugated flexible membrane 241 and illustrate the contour shape of the corrugation(s) of corrugated flexible membrane 241. As shown in FIGS. 7A-7C, the troughs of corrugations of corrugated flexible membrane 241 and contour shape of the corrugation(s) of corrugated flexible membrane 241 are symmetric about the center point of flexible membrane 241.

Liquid dispenser 100, 200 is typically formed from a semiconductor material (for example, silicon) using semiconductor fabrication techniques (for example, CMOS circuit fabrication techniques, micro-electro mechanical structure (MEMS) fabrication techniques, or a combination of both). Alternatively, liquid dispenser 100, 200 can be formed using conventional materials and fabrication techniques known in the art.

A liquid dispenser array structure made according to the present invention includes a plurality of liquid dispensers 100, 200 described above with reference to FIGS. 1-7C. The plurality of liquid dispensers 100, 200 are formed, for example, integrally formed through a series of material layering and processing steps, on a common substrate typically using the fabrication techniques described above to create a monolithic liquid dispenser structure. When compared to other types of liquid dispensers, monolithic liquid dispenser configurations help to improve the alignment of each nozzle opening relative to other nozzle openings which improves drop deposition accuracy. Monolithic liquid dispenser configurations also help to reduce spacing in between adjacent nozzle openings which can increase the dots per inch (dpi) capability of the device.

The invention has been described in detail with particular reference to certain preferred embodiments thereof, but it will be understood that variations and modifications can be effected within the scope of the invention.

PARTS LIST

100 liquid dispenser
111 first liquid chamber
112 second liquid chamber
120 nozzle
130 heater
130*a,b* split heater
135 center point of the heater
140 flexible corrugated membrane
145 trough pattern of corrugation
160 vapor bubble
170 liquid drop

200 liquid dispenser with a circulating working fluid
211 first liquid chamber
212 second liquid chamber
215 outer contour of the first liquid chamber
220 nozzle
230 heater
240 flexible membrane
241 flexible membrane
251 liquid supply channel
252 liquid return channel
255 liquid supply
257 pressure source
259 pressure source

The invention claimed is:

1. A liquid dispenser comprising:

a first liquid chamber including a nozzle, the nozzle including a center point;

a second liquid chamber;

a split heater associated with the second liquid chamber, the split heater including a center point and two halves symmetrically positioned relative to the center point;

a flexible corrugated membrane positioned to separate and fluidically seal the first liquid chamber and the second liquid chamber, wherein the center points of the nozzle and the split heater are collinear relative to each other.

2. The liquid dispenser of claim 1, the flexible corrugated membrane including a center point, wherein the center points of the nozzle, the heater, and the flexible corrugated membrane are collinear relative to each other.

3. The liquid dispenser of claim 1, the first liquid chamber including a first liquid and the second liquid chamber including a second liquid, wherein the first liquid and the second liquid are different liquids.

4. The liquid of dispenser of claim 3, wherein the second liquid has a lower boiling point when compared to first liquid.

5. The liquid of dispenser of claim 3, wherein the second liquid is a non-corrosive liquid.

6. The liquid dispenser of claim 1, the corrugated flexible membrane including a plurality of corrugations, wherein the plurality of corrugations include heights that are different when compared to each other.

7. The liquid dispenser of claim 6, the corrugated flexible membrane including a plurality of corrugations, wherein the plurality of corrugations include a pitch that is different when compared to each other.

8. The liquid dispenser of claim 1, the corrugated flexible membrane including a plurality of corrugations, wherein the plurality of corrugations include a pitch that is different when compared to each other.

9. The liquid dispenser of claim 1, wherein the corrugated flexible membrane includes a flat center region.

10. The liquid dispenser of claim 6, the corrugated flexible membrane including a contour shape, the first liquid chamber including an outer contour shape, wherein the contour shape of the corrugated flexible membrane is the same as the outer contour shape of the first liquid chamber.

11. The liquid dispenser of claim 10, wherein the outer contour shape of the first liquid chamber is one of a circular shape, an oval shape, and a complex shape.

* * * * *